US009978350B1

(12) United States Patent
Lin

(10) Patent No.: US 9,978,350 B1
(45) Date of Patent: May 22, 2018

(54) SOUND SOURCE NOISE-SUPPRESSING DRUM STRUCTURE

(71) Applicant: Sound & Light Co., Ltd., Taipei (TW)

(72) Inventor: Chih Hong Lin, Taipei (TW)

(73) Assignee: SOUND & LIGHT CO., LTD., Taipei (TW)

( * ) Notice: Subject to any disclaimer, the term of this patent is extended or adjusted under 35 U.S.C. 154(b) by 0 days. days.

(21) Appl. No.: 15/659,854

(22) Filed: Jul. 26, 2017

(30) Foreign Application Priority Data

May 24, 2017 (TW) ..... 106207402 U

(51) Int. Cl.
*G10D 13/02* (2006.01)
*G10H 1/32* (2006.01)
*G10H 3/00* (2006.01)
*G10H 3/14* (2006.01)

(52) U.S. Cl.
CPC ..... *G10D 13/024* (2013.01); *G10H 3/146* (2013.01)

(58) Field of Classification Search
CPC ..... G10D 13/024; G10H 3/146
USPC ..... 84/743
See application file for complete search history.

(56) References Cited

U.S. PATENT DOCUMENTS 4,581,972 A * 4/1986 Hoshino ..... G10D 13/024 84/411 P
4,581,973 A * 4/1986 Hoshino ..... G10D 13/024 84/411 P
4,679,479 A * 7/1987 Koyamato ..... G10D 13/024 84/741
4,947,725 A * 8/1990 Nomura ..... G10D 13/024 84/723
5,042,356 A * 8/1991 Karch ..... G10D 13/024 84/104
5,105,710 A * 4/1992 Rothmel ..... G10D 13/024 84/730
6,576,829 B1 * 6/2003 Hart ..... G10H 3/146 84/104

(Continued)

FOREIGN PATENT DOCUMENTS

CN 205038963 U * 2/2016
WO WO 2009110838 A1 * 9/2009 ..... G10D 13/027

*Primary Examiner* — David Warren
*Assistant Examiner* — Christina Schreiber
(74) *Attorney, Agent, or Firm* — Han IP Corporation; Andy M. Han

(57) ABSTRACT

An electronic percussion instrument for suppressing sound source noise is described. The instrument includes a percussion pad, a metal plate disposed below the percussion pad, at least one damping element disposed in a ring-like manner below the metal plate, a resonance conductive member disposed below the damping element, a sensor disposed at a central region below the resonance conductive member, and a noise suppressing mechanism disposed at a peripheral annular region below the resonance conductive member. The noise suppressing mechanism includes, in an order from top to bottom, a foam ring and a metal ring. The metal ring has a plurality of cushioning elements thereon. Accordingly, the instrument can effectively suppress or otherwise eliminate interference on and noise sensed by the sensor caused by vibration of a casing when the percussion pad is percussed. This can greatly improve the sound effect and performance of the instrument.

9 Claims, 6 Drawing Sheets

(56) References Cited

U.S. PATENT DOCUMENTS 6,720,491 B1 * 4/2004 Kroncke ..... G10D 13/06 84/422.3
6,756,535 B1 * 6/2004 Yoshino ..... G10D 13/024 84/414
6,982,376 B2 * 1/2006 Wise ..... G10H 3/146 84/104
7,439,432 B2 * 10/2008 Hiraku ..... G10D 13/024 84/411 P
7,465,869 B1 * 12/2008 Freitas ..... G10H 3/10 84/687
8,039,724 B1 * 10/2011 Norman ..... G10H 3/146 84/411 M
8,686,264 B2 * 4/2014 Morita ..... G10H 1/32 84/413
8,916,759 B2 * 12/2014 Hashimoto ..... G10D 13/027 84/411 R
9,424,827 B2 * 8/2016 Gill ..... G10H 3/12
2004/0025663 A1 * 2/2004 Harada ..... G10D 13/024 84/104
2005/0022655 A1 * 2/2005 Wise ..... G10H 3/146 84/743
2005/0150366 A1 * 7/2005 Susami ..... G10H 3/146 84/735
2006/0021495 A1 * 2/2006 Freitas ..... G10H 3/10 84/723
2007/0234886 A1 * 10/2007 Matsuyuki ..... G10D 13/024 84/723
2009/0151475 A1 * 6/2009 Masaki ..... G01L 1/146 73/862.68
2009/0229450 A1 * 9/2009 Hashimoto ..... G10D 13/024 84/723
2010/0180755 A1 * 7/2010 Copeland ..... G10H 1/0066 84/622
2012/0174732 A1 * 7/2012 Martinazzi ..... G10D 13/021 84/411 R
2013/0340598 A1 * 12/2013 Marquez ..... G10H 1/0558 84/730
2014/0260918 A1 * 9/2014 Kanayama ..... G10H 3/146 84/730
2014/0260921 A1 * 9/2014 Kanayama ..... G10H 3/146 84/730
2015/0027301 A1 * 1/2015 Shih ..... G10H 3/12 84/730
2016/0247492 A1 * 8/2016 Field ..... G10D 13/024
2017/0116972 A1 * 4/2017 Yoshino ..... G10H 3/146

* cited by examiner

SOUND SOURCE NOISE-SUPPRESSING DRUM STRUCTURE

CROSS REFERENCE TO RELATED PATENT APPLICATION(S)

The present disclosure claims the priority benefit of Taiwan Patent Application No. 106207402, filed 24 May 2017, the content of which is incorporated by reference in its entirety.

TECHNICAL FIELD

The present disclosure relates to the field of electronic percussion instruments and, more particularly, to a drum structure capable of suppressing sound source noises.

BACKGROUND

Traditional drums or cymbals and other percussion instruments use the percussion produced by the vibration of the air and/or other media to change the pressure and density to produce sound. However, as the volume of the sound cannot be arbitrarily controlled or adjusted, it easy to interfere with others when a player practices on a traditional drum or cymbal. Hence, electronic percussion instruments, such as electronic drums, have been introduced. The main structure of existing electronic drums typically includes a pad and a sensor coupled to a side of the pad so that when the pad is hit the sensor can detect and produce a corresponding percussion signal. The percussion signal is processed by an audio system, or sound module, to output a corresponding sound of drum or cymbal to a headset or speaker. As the pad does not produce a loud sound when percussed, interference to others can be minimized when one wears a headset when practicing on an electronic drum.

However, there are still areas for improvement in existing electronic drums. Firstly, when the pad is percussed, the vibration energy generated by the percussed pad is passed to a sensor and beyond, typically also to a casing of the electronic drum. This causes the casing to also vibrate and, consequently, result in interference and noise to the sensor, thereby negatively impacting the sound effect outputted by the electronic drum. There is currently no known solution to suppress such noise. Secondly, existing electronic drums usually do not have a built-in audio system, and often need to be connected to an external audio system in order to produce a variety of tones and/or volumes of the sound of the drum. This makes carrying and usage of the electronic drum rather inconvenient.

SUMMARY

This section highlights a select number of embodiments as non-limiting illustrative examples of implementation of the inventive concept of the present disclosure. Accordingly, the scope of the claims in the present application is not limited to embodiments presented herein. Unless otherwise indicated herein, embodiments described in this section are not prior art to the claims in the present application and are not admitted as prior art by inclusion in this section.

In view of aforementioned issues with existing electronic percussion instruments, an objective of the present disclosure is to provide an electronic percussion instrument that can effectively suppress noise. Another objective of the present disclosure is to provide an electronic percussion instrument with a built-in audio system.

To achieve the objectives stated above, the present disclosure provides an electronic percussion instrument capable of suppressing sound source noise. The electronic percussion instrument may include a percussion pad, a metal plate disposed below the percussion pad, at least one damping element disposed in a ring-like manner below the metal plate, a resonance conductive member disposed below the at least one damping element, a percussion pad sensor disposed at a central region below the resonance conductive member, and a noise suppressing mechanism disposed at a peripheral annular region below the resonance conductive member. The noise suppressing mechanism may include a foam ring and a metal ring. The metal ring may include a plurality of cushioning elements thereon that are arranged in a ring-like manner on an outer periphery of the metal ring such that each of the plurality of cushioning elements simultaneously contacts a top surface, a side surface and a bottom surface of the metal ring.

In some embodiments, a bottom surface of the percussion pad may include a monolithic inner annular groove, and the metal plate may be fitted to the inner annular groove of the percussion pad.

In some embodiments, the electronic percussion instrument may also include a casing. The percussion pad, the metal plate, the damping element, the resonance conductive element, the percussion pad sensor and the noise suppressing mechanism may be respectively disposed inside the casing.

In some embodiments, the electronic percussion instrument may further include a bottom pad disposed below the casing.

Alternatively or additionally, the electronic percussion instrument may further include a digital audio module disposed inside the casing. The digital audio module may be electrically coupled to the percussion pad sensor.

In some embodiments, the casing may include a base, an upper cover and a side cover. Both the upper cover and the side cover may be hollow.

In some embodiments, the noise suppressing mechanism may be disposed between the resonance conductive element and the upper cover of the casing.

In some embodiments, electronic percussion instrument may also include a left sensor and a right sensor. The upper cover may include a receiving portion, with the left sensor and the right sensor disposed in the receiving portion.

In some embodiments, the base may be provided with at least one output terminal on a side thereof.

Advantageously, the noise suppressing mechanism can greatly minimize or avoid vibration from being passed to the casing via the resonance conductive element when the percussion pad is percussed. This can effectively suppress or eliminate the interference on and noise sensed by the percussion pad sensor caused by vibration of the casing. As a result, the sound effect and performance of the instrument can be greatly improved.

BRIEF DESCRIPTION OF THE DRAWINGS

The accompanying drawings are included to aid further understanding of the present disclosure, and are incorporated in and constitute a part of the present disclosure. The drawings illustrate a select number of embodiments of the present disclosure and, together with the detailed description below, serve to explain the principles of the present disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

For ease of explanation, example implementations of an electronic percussion instrument as an electronic drum are used in the detailed description provided below and in the associated figures. It would be understandable to those of ordinary skill in the art that the technical solutions in accordance with the present disclosure, in view of examples provided herein, may be implemented in other types of electronic percussion instruments, such as cymbals, to achieve the same effect.

Figure 1:
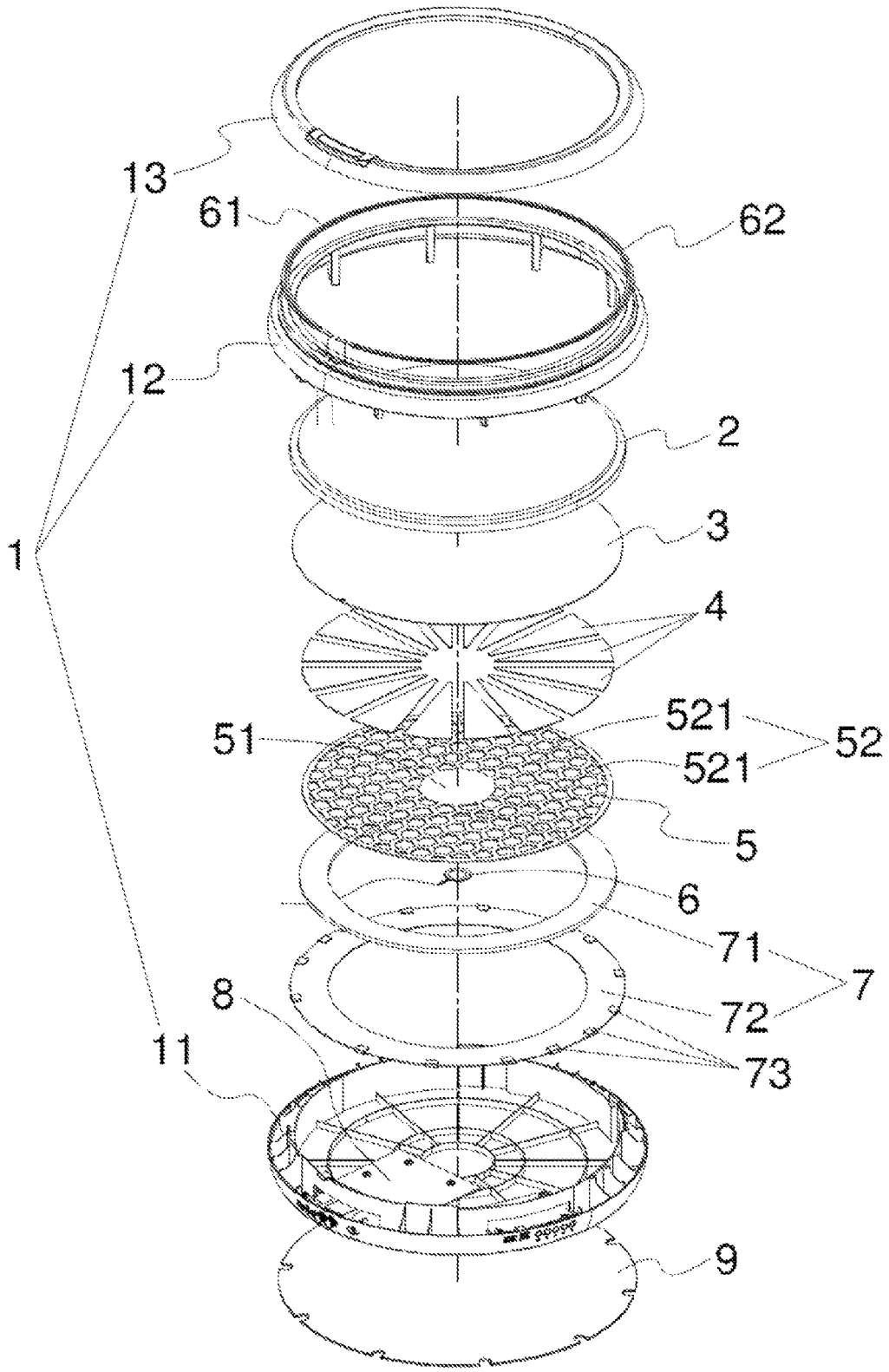
FIG. 1 is an exploded view of an embodiment in accordance with the present disclosure.
Figure 2:
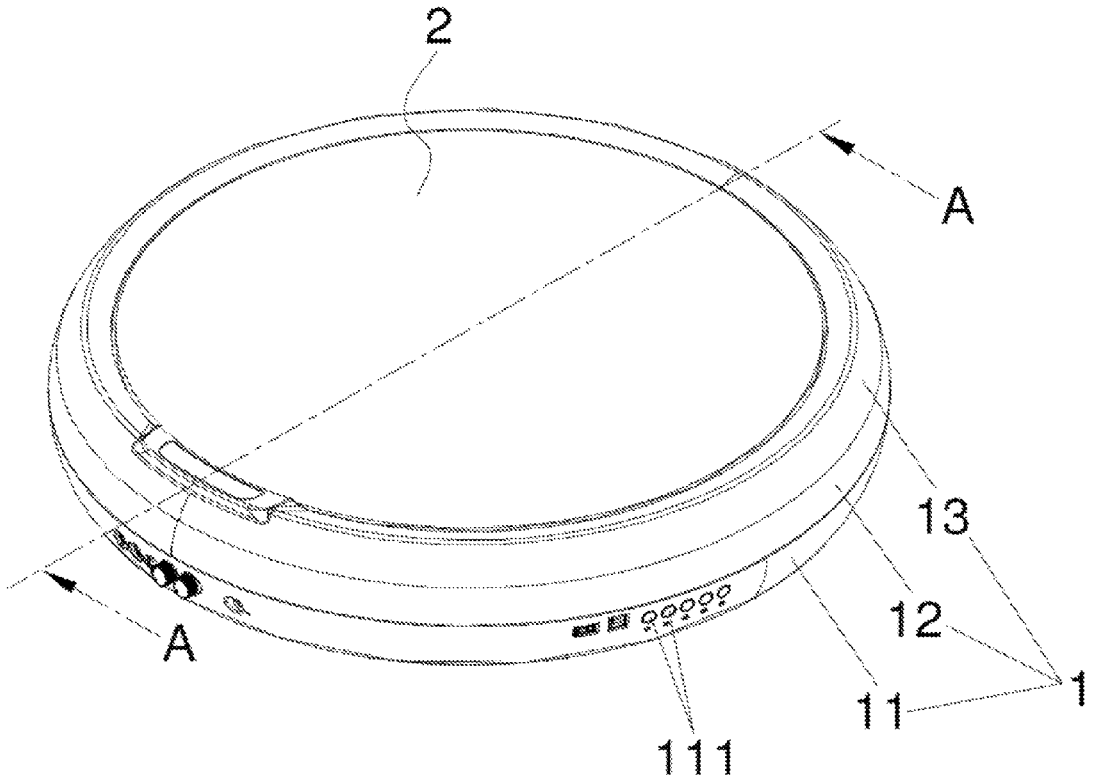
FIG. 2 is an assembly view of an embodiment in accordance with the present disclosure.

FIG. 1 and FIG. 2 illustrate different views of an embodiment of an electronic percussion instrument in accordance with the present disclosure.

Figure 3:
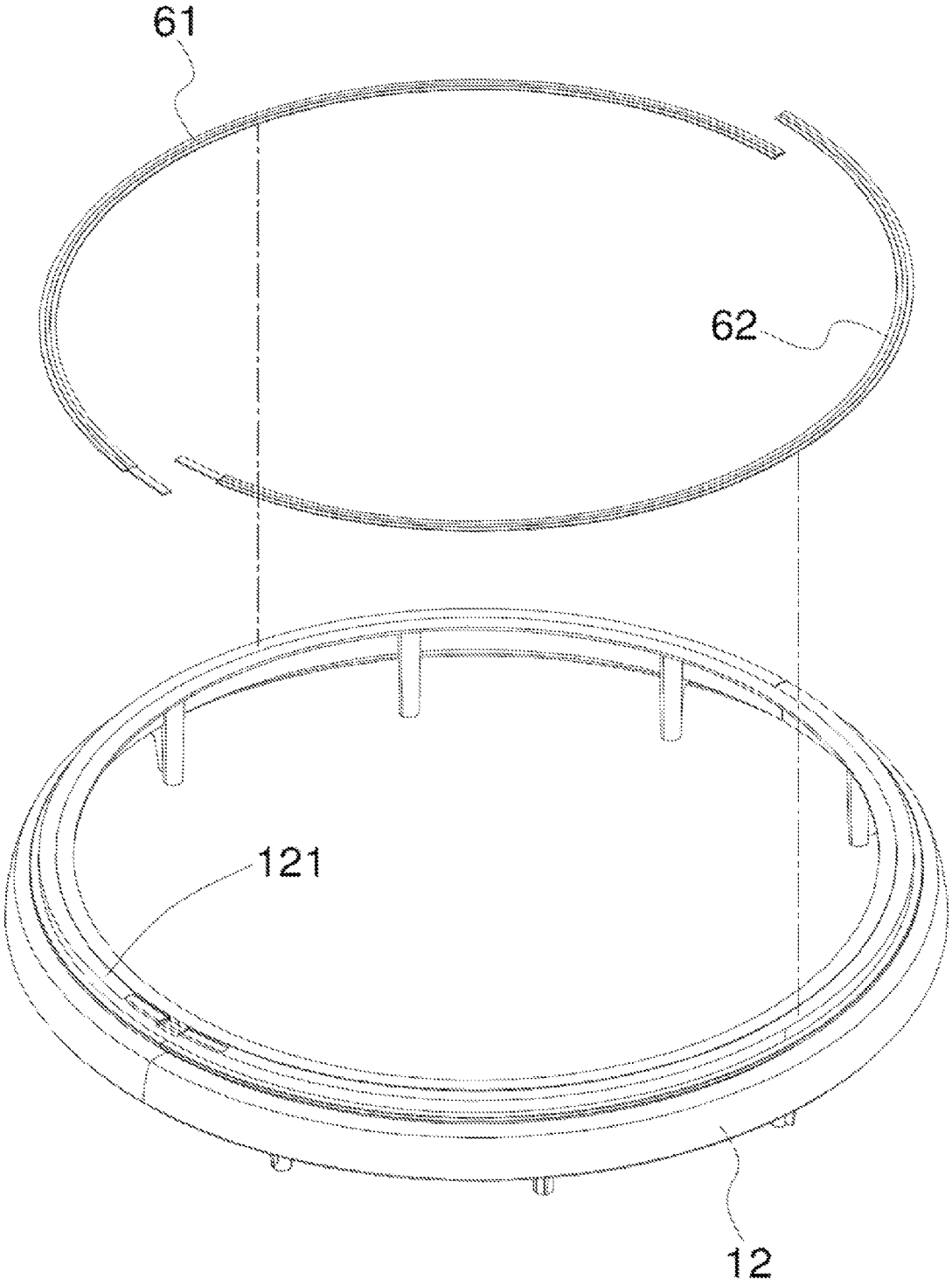
FIG. 3 is a diagram of a side frame and a side sensor in accordance with an embodiment of the present disclosure.

The electronic percussion instrument includes a casing 1. In one embodiment, casing one includes, in an order from bottom to top: a base 11, an upper cover 12 and a side cover 13. The base 11 and side cover 13 are disposed and coupled to a lower side and an upper side of upper cover 12, respectively. Upper cover 12 and side cover 13 are both hollow. Side cover 13 constitutes one of the percussion areas of the electronic percussion instrument of the present disclosure. On a side of casing 1, at least one output terminal 111 is provided to which a headset or one or more speakers (not shown) can be connected. More specifically, in one embodiment, the at least one output terminal 111 is disposed at a side of base 11. Referring to FIG. 3, the upper side of upper cover 12 may include a receiving portion 121 which may be shaped as an annular groove.

Generally speaking, for the sake of similarity in appearance to conventional percussion instruments such as drums, a cross section of casing 1 or base 11 can be designed to be round in shape although it is not necessary. Each of upper cover 12 and side cover 13 has a shape profile that corresponds to base 11.

Figure 5:
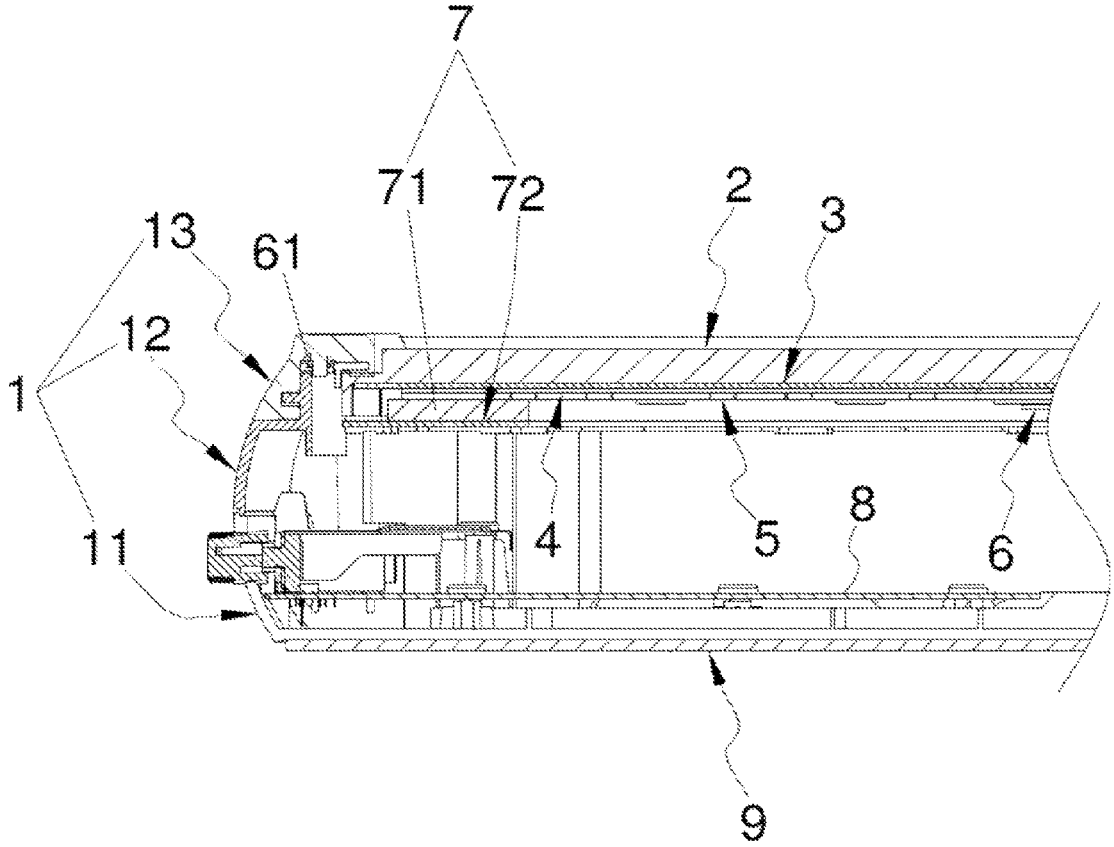
FIG. 5 is a diagram of a cross-sectional view along a line A-A of FIG. 2.

The electronic percussion instrument also includes a percussion pad 2, which is disposed inside casing 1 and constitutes one of the percussion areas of the electronic percussion instrument of the present disclosure. When percussed, the percussion pad 2 produces vibrations. In one embodiment, percussion pad 2 and side cover 13 can be made of an elastic material such as, for example and without limitation, silicone, rubber, a highly polymerized foaming material or the like. Referring to FIG. 5, percussion pad 2 can be fixedly attached to casing 1 below side cover 13. Since both upper cover 12 and side cover 13 are hollow, upon assembly most part of percussion pad 2 will not be covered and can still be exposed. Moreover, in one embodiment, a bottom surface of percussion pad 2 includes a monolithically-formed inner annular groove 21.

Figure 4:
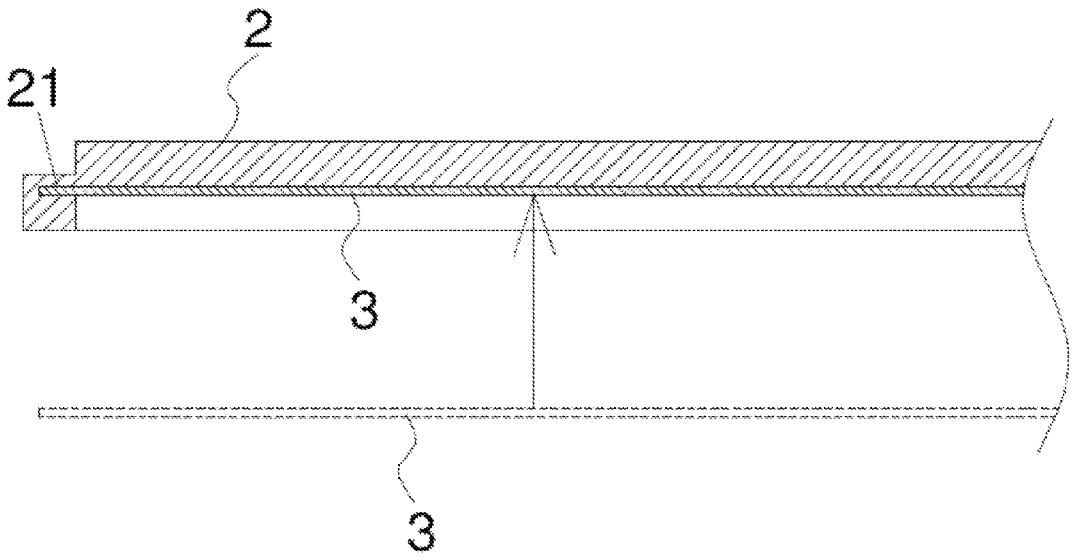
FIG. 4 is a diagram of an assembly of a percussion pad and a metal plate in accordance with an embodiment of the present disclosure.

The electronic percussion instrument also includes a metal plate 3, which is disposed inside casing 1. Metal plate 3 is disposed and connected to a lower side of percussion pad 2. Percussion pad 2 and metal plate 3 can be coupled together by any suitable method such as adhesive bonding, mechanical engagement or mechanical fitting. Referring to FIG. 4, in one embodiment, metal plate 3 and the inner annular groove 21 of percussion pad 2 are fitted together. Accordingly, the electronic percussion instrument of the present disclosure can be conveniently and quickly assembled.

The electronic percussion instrument also includes at least one damping element 4, which is disposed inside casing 1. Damping element 4 is disposed in a ring-like manner below metal plate 3. In one embodiment, the at least one damping element 4 is made of a foaming material, e.g., sponge foam, such as a foam pad or a double-sided adhesive with a foam layer in the middle, for example. The shape of each of the at least one damping element 4 may be, for example and without limitation, triangle, fan, trapezoid or any other shape.

The electronic percussion instrument also includes a resonance conductive member 5, which is disposed inside casing 1. Resonance conductive member 5 is disposed below the at least one damping element 4. In one embodiment, resonance conductive member 5 and the at least one damping element 4 are bonded together by adhesive. Accordingly, resonance conductive member 5 can resonate with the vibrations generated by percussion pad 2 when percussion pad 2 is hit or otherwise percussed by a player. Resonance conductive member 5 includes a central region that defines a sensor connection portion 51. Resonance conductive member 5 also includes a conductive pattern 52 surrounding and connected to the sensor connection portion 51. The sensor connection portion 51 is defined by a solid round plate. Referring to FIG. 1, in one embodiment, the conductive pattern 52 is defined by multiple honeycomb-shaped or hexagonal-shaped hollow grids 521. In other embodiments, the conductive pattern 52 can be a spider web-like pattern or any other suitable pattern without limitation. Neither the structure nor the functionality of resonance conductive member 5 is a key feature of the present disclosure and, thus, in the interest of brevity a detailed description thereof is not further provided herein.

The electronic percussion instrument also includes a percussion pad sensor 6, which is disposed inside casing 1. Percussion pad sensor 6 is disposed and connected to (e.g., by adhesive bonding) a lower side of resonance conductive member 5. In one embodiment, percussion pad sensor 6 is disposed on the sensor connection portion 51 of resonance conductive member 5. In one embodiment, percussion pad sensor 6 includes a piezoelectric sensor.

Figure 6:
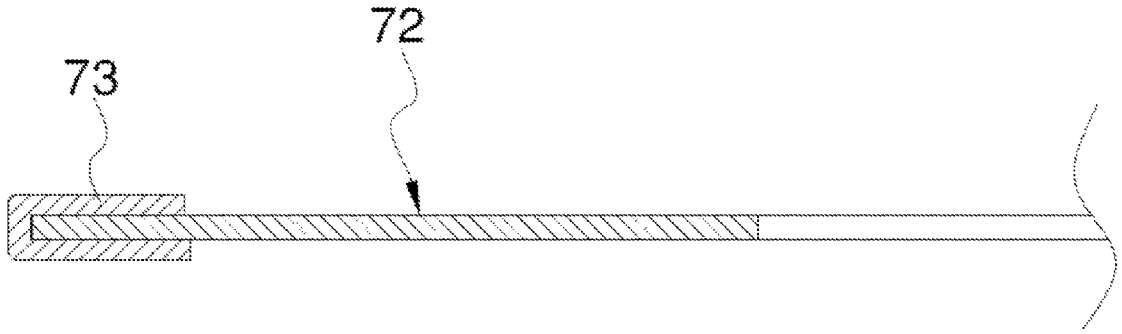
FIG. 6 is a cross-sectional view of a portion of a metal ring in accordance with an embodiment of the present disclosure.

The electronic percussion instrument also includes a noise suppressing mechanism 7, which is disposed inside casing 1. In one embodiment, referring to FIG. 5, noise suppressing mechanism 7 is disposed below resonance conductive member 5, and is also disposed between resonance conductive member 5 and upper cover 12. Noise suppressing mechanism 7 includes, in an order from top to bottom: a foam ring 71 and a metal ring 72 (e.g., iron ring or steel ring). Foam ring 71 is disposed below resonance conductive member 5, and metal ring 72 is disposed on or above upper cover 12. In one embodiment, foam ring 71 is snuggly in direct contact with the bottom surface of resonance conductive member 5. It is noteworthy that, as foam ring 71 is a ring-shaped object with a void therein, resonance conductive member 5 is in contact with foam ring 71 by a ring-shaped portion near an outer periphery thereof. That is, noise suppressing mechanism 7 is disposed below resonance conductive member 5 in a ring-shaped region. As such noise suppressing mechanism 7 and percussion pad sensor 6 will not interfere with each other. Moreover, referring to FIG. 6, metal ring 72 has multiple cushioning elements 73 disposed thereon. The multiple cushioning elements 73 are arranged in a ring-like manner on an outer periphery of metal ring 72 such that each of the cushioning elements 73 simultaneously contacts a top surface, a side surface and a bottom surface of metal ring 72. Cushioning elements 73 can be made of an elastic material such as, for example and without limitation, rubber or silicone. In some embodiments, foam ring 71 and metal ring 72 are circular rings. Alternatively, each of foam ring 71 and metal ring 72 can be in a different shape such as, for example and without limitation, triangle, square, pentagon and the like. The shape of foam ring 71 and the shape of metal ring 72 need not be the same.

Referring to FIG. 1 and FIG. 3, in some embodiments, the electronic percussion instrument also includes a left sensor 61 and a right sensor 62. Left sensor 61 and right sensor 62 are disposed between upper cover 12 and side cover 13 to sense percussions to side cover 13. In one embodiment, left sensor 61 and right sensor 62 are disposed on the receiving portion of upper cover 12 (e.g., inside the annular groove). In one embodiment, each of left sensor 61 and right sensor 62 is approximately semi-circular and arc-shaped.

Referring to FIG. 1, in some embodiments, the electronic percussion instrument also includes a digital audio module 8 (or sound module), which is disposed inside casing 1. Each of digital audio module 8, percussion pad sensor 6, left sensor 61 and right sensor 62 is electrically connected to output terminal 111. Digital audio module 8 includes necessary processing circuitry and can store a variety of tones and sound sources. Neither the structure nor the functionality of digital audio module 8 is a key feature of the present disclosure and, thus, in the interest of brevity a detailed description thereof is not further provided herein.

In operation, referring to FIG. 1 and FIG. 5, when a player percusses percussion pad 2, the vibrations thus generated are conducted to metal plate 3, damping element 4, resonance conductive member 5 and then percussion pad sensor 6, thereby causing percussion pad sensor 6 to generate an electric signal corresponding to the sensed vibrations. The electric signal is provided to digital audio module 8, which processes the electric signal to provide a corresponding sound of a music instrument via output terminal 111 and headset(s) or speaker(s). Moreover, when the player percusses the side cover 13, left sensor 61 and right sensor 62, which are disposed between side cover 13 and upper cover 12, can sense the vibrations and generate corresponding electric signals. The electric signals are provided to digital audio module 8 to provide sounds of a music instrument as described above.

Referring to FIG. 1 and FIG. 5, with the utilization of noise suppressing mechanism 7, which is disposed between resonance conductive member 5 and upper cover 12 of casing 1, as well as the components thereof (e.g., cushioning elements 73 on metal ring 72), conduction of vibrations by resonance conductive member 5 to casing 1 is greatly reduced or otherwise avoided when percussion pad 2 is percussed. Accordingly, interference on and noise sensed by percussion pad sensor 6, as a result of the vibration of casing 1, can be effectively suppressed or otherwise avoided. Moreover, with the built-in digital audio module 8 inside casing 1, which is internal and not external, the electronic percussion instrument of the present disclosure can both perform percussion and output digital sound. This greatly enhances the convenience in carrying and usage of the electronic percussion instrument. Furthermore, as the output terminal 111 is disposed on a side of casing 1, instead of being disposed on top (e.g., a top surface) of casing 1 as with some conventional electronic drums, any influence or obstruction on the percussion movement of the player due to the output terminal is thus avoided. This further enhances user experience of the electronic percussion instrument of the present disclosure.

Referring to FIG. 1, the electronic percussion instrument can further include a bottom pad 9, which is fixedly disposed below casing 1. Bottom pad 9 can be made of an elastic material. Thus, no matter what supporting object is used to support the electronic percussion instrument, whether a table or a support frame, bottom pad 9 can dampen the percussion vibrations to minimize the amount of vibrations conducted to the supporting object. This helps further reduce the noise produced to prevent interference with others. Bottom pad 9 can also provide an anti-slippage effect to prevent the electronic percussion instrument from moving when being percussed, thereby further enhancing the utility of the electronic percussion instrument.

ADDITIONAL AND ALTERNATIVE IMPLEMENTATION NOTES

Although the techniques have been described in language specific to certain applications, it is to be understood that the appended claims are not necessarily limited to the specific features or applications described herein. Rather, the specific features and examples are disclosed as non-limiting exemplary forms of implementing such techniques.

In the above description of exemplary implementations, for purposes of explanation, specific numbers, materials configurations, and other details are set forth in order to better explain the invention, as claimed. However, it will be apparent to one skilled in the art that the claimed invention may be practiced using different details than the exemplary ones described herein. In other instances, well-known features are omitted or simplified to clarify the description of the exemplary implementations.

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. An electronic percussion instrument capable of suppressing sound source noise, comprising:

a percussion pad;

a metal plate disposed below the percussion pad;

at least one damping element disposed in a ring-like manner below the metal plate;

a resonance conductive member disposed below the at least one damping element;

a percussion pad sensor disposed at a central region below the resonance conductive member; and a noise suppressing mechanism disposed at a peripheral annular region below the resonance conductive member, the noise suppressing mechanism comprising a foam ring and a metal ring, wherein the metal ring comprises a plurality of cushioning elements thereon that are arranged in a ring-like manner on an outer periphery of the metal ring such that each of the plurality of cushioning elements simultaneously contacts a top surface, a side surface and a bottom surface of the metal ring.

2. The electronic percussion instrument of claim 1, wherein a bottom surface of the percussion pad comprises a monolithic inner annular groove, and wherein the metal plate is fitted to the inner annular groove of the percussion pad.

3. The electronic percussion instrument of claim 1, further comprising a casing, wherein the percussion pad, the metal plate, the damping element, the resonance conductive element, the percussion pad sensor and the noise suppressing mechanism are respectively disposed inside the casing.

4. The electronic percussion instrument of claim 3, further comprising a bottom pad disposed below the casing.

5. The electronic percussion instrument of claim 3, further comprising a digital audio module disposed inside the casing, wherein the digital audio module is electrically coupled to the percussion pad sensor.

6. The electronic percussion instrument of claim 3, wherein the casing comprises a base, an upper cover and a side cover, and wherein both the upper cover and the side cover are hollow.

7. The electronic percussion instrument of claim 6, wherein the noise suppressing mechanism is disposed between the resonance conductive element and the upper cover of the casing.

8. The electronic percussion instrument of claim 6, further comprising a left sensor and a right sensor, wherein the upper cover comprises a receiving portion, and wherein the left sensor and the right sensor are disposed in the receiving portion.

9. The electronic percussion instrument of claim 6, wherein the base is provided with at least one output terminal on a side thereof.

* * * * *